US006782950B2

(12) United States Patent
Amin et al.

(10) Patent No.: US 6,782,950 B2
(45) Date of Patent: Aug. 31, 2004

(54) CONTROL WELLHEAD BUOY

(75) Inventors: Rajnikant M. Amin, Houston, TX (US); James F. O'Sullivan, Houston, TX (US); David A. Gray, Houston, TX (US)

(73) Assignee: Kellogg Brown & Root, Inc., Houston, TX (US)

( * ) Notice: Subject to any disclaimer, the term of this patent is extended or adjusted under 35 U.S.C. 154(b) by 0 days.

(21) Appl. No.: 09/796,295

(22) Filed: Feb. 28, 2001

(65) Prior Publication Data

US 2002/0044838 A1 Apr. 18, 2002

Related U.S. Application Data

(63) Continuation-in-part of application No. 09/675,623, filed on Sep. 29, 2000.

(51) Int. Cl.[7] ..... E21B 41/06; E21B 43/017; B63B 22/24

(52) U.S. Cl. ..... 166/369; 166/354; 166/366; 405/210; 405/224.4; 114/230.13; 441/3

(58) Field of Search ..... 166/352, 354, 166/356, 369, 381, 335, 351; 175/7; 405/224, 224.2, 224.4, 210, 196, 200; 441/3, 4, 5; 114/230.13, 230.14

(56) References Cited

U.S. PATENT DOCUMENTS

| | | | | | |
|---|---|---|---|---|---|
| 3,219,118 | A | * | 11/1965 | Lewis | 166/351 |
| 3,299,846 | A | * | 1/1967 | Jarlan | 114/264 |
| 3,469,627 | A | * | 9/1969 | Baker | 166/356 |
| 3,504,740 | A | * | 4/1970 | Manning | 166/339 |
| 3,504,741 | A | * | 4/1970 | Baker et al. | 166/267 |
| 3,520,358 | A | * | 7/1970 | Brooks et al. | 166/356 |
| 3,545,539 | A | * | 12/1970 | Manning | 166/356 |
| 3,643,736 | A | * | 2/1972 | Talley, Jr. | 166/245 |
| 3,780,685 | A | * | 12/1973 | Horton | 114/265 |
| 3,855,656 | A | | 12/1974 | Blenkarn | 166/350 |
| 3,984,059 | A | * | 10/1976 | Davies | 405/210 |
| 4,117,691 | A | * | 10/1978 | Spray | 405/205 |
| 4,138,752 | A | * | 2/1979 | Dickson | 441/23 |
| 4,265,313 | A | * | 5/1981 | Arnaudeau | 166/366 |
| 4,284,143 | A | | 8/1981 | Scherrer et al. | 166/350 |
| 4,421,436 | A | | 12/1983 | Burns | 405/60 |
| 4,434,741 | A | * | 3/1984 | Wright et al. | 114/264 |

(List continued on next page.)

FOREIGN PATENT DOCUMENTS

| | | | | |
|---|---|---|---|---|
| WO | WO 99/50526 A1 | * | 10/1999 | E21B/00/00 |
| WO | WO 00/56982 A1 | * | 9/2000 | E02B/17/00 |

OTHER PUBLICATIONS

William Furlow, *Solution for Subsea Tiebacks can Lower Reserve Hurdle Rate* [online] Retrieved from the Internet:<URL: www.offshore–mag.com Apr. 2000 (6 p.).

*Offshore Platforms* [online] Retrieved from the Internet: < URL: www.oil–gas.uwa.edu.au'platforms.html Dec. 12, 2000 (5 p.).

*Conceptual Design Report for Control and Power Buoys;* Global ETP/SPPS Development; Jun. 1, 2000 (pp. 29–42).

*Primary Examiner*—David Bagnell
*Assistant Examiner*—Jennifer H Gay
(74) *Attorney, Agent, or Firm*—Conley Rose, P.C.

(57) ABSTRACT

The present invention relates to a subsea system for the production of hydrocarbon reserves. More specifically, the present invention relates to a control wellhead bouy that is used in deepwater operations for offshore hydrocarbon production. In a preferred embodiment, a bouy for supporting equipment for use in a remote offshore well or pipeline includes a hull having a diameter:height ratio of at least 3:1, a mooring system for maintaining the hull in a desired location, and an umbilical providing fluid communication between the hull and the well or pipeline.

33 Claims, 2 Drawing Sheets

U.S. PATENT DOCUMENTS

| | | | | | |
|---|---|---|---|---|---|
| 4,516,882 | A | * | 5/1985 | Brewer et al. | 405/224 |
| 4,653,960 | A | | 3/1987 | Chun | 405/210 |
| 4,730,677 | A | | 3/1988 | Pearce et al. | 166/345 |
| 4,768,984 | A | | 9/1988 | DeOliveira et al. | 441/21 |
| H611 | H | * | 4/1989 | Peace | 114/264 |
| 4,934,871 | A | | 6/1990 | Kazokas, Jr. | 405/224 |
| 4,995,762 | A | * | 2/1991 | Goldman | 114/264 |
| 5,226,482 | A | * | 7/1993 | Giannesini et al. | 166/353 |
| 5,295,546 | A | * | 3/1994 | Giannesini et al. | 166/353 |
| 5,390,743 | A | * | 2/1995 | Giannesini | 166/352 |
| 5,558,467 | A | | 9/1996 | Horton | 405/195.1 |
| 5,706,897 | A | | 1/1998 | Horton, III | 166/359 |
| 5,778,981 | A | * | 7/1998 | Head | 166/345 |
| 5,881,815 | A | | 3/1999 | Horton, III | 166/350 |
| 5,885,028 | A | * | 3/1999 | Blanchard et al. | 405/210 |
| 5,964,550 | A | * | 10/1999 | Blandford et al. | 405/224 |
| 6,092,483 | A | * | 7/2000 | Allen et al. | 114/264 |
| 6,102,124 | A | | 8/2000 | Skeels et al. | 166/347 |
| 6,155,748 | A | | 12/2000 | Allen et al. | 166/350 |
| 6,328,107 | B1 | | 12/2001 | Maus | 166/335 |

* cited by examiner

CONTROL WELLHEAD BUOY

RELATED APPLICATIONS

The present application is a continuation-in-part of U.S. Ser. No. 09/675,623, filed Sep. 29, 2000, and entitled "Extended Reach Tie-Back System."

TECHNICAL FIELD OF THE INVENTION

The present invention relates to an offshore system for the production of hydrocarbon reserves. More specifically, the present invention relates to an offshore system suitable for deployment in economically and technically challenging environments. Still more specifically, the present invention relates to a control buoy that is used in deepwater operations for offshore hydrocarbon production.

BACKGROUND OF THE INVENTION

In the mid-1950s, the production of oil and gas from oceanic areas was negligible. By the early 1980s, about 14 million barrels per day, or about 25 percent of the world's production, came from offshore wells, and the amount continues to grow. More than 500 offshore drilling and production rigs were at work by the late 1980s at more than 200 offshore locations throughout the world drilling, completing, and maintaining offshore oil wells. Estimates have placed the potential offshore oil resources at about 2 trillion barrels, or about half of the presently known onshore potential oil sources.

It was once thought that only the continental-shelf areas contained potential petroleum resources, but discoveries of oil deposits in deeper waters of the Gulf of Mexico (about 3,000 to 4,000 meters) have changed that view. It is now known that the continental slopes and neighboring seafloor areas contain large oil deposits, thus enhancing potential petroleum reserves of the ocean bottom.

Offshore drilling is not without its drawbacks, however. It is difficult and expensive to drill on the continental shelf and in deeper waters. Deepwater operations typically focus on identifying fields in the area of 100 million bbl or greater because it takes such large reserves to justify the expense of production. Only about 40% of deepwater finds have more than 100 million barrels of recoverable oil equivalent.

As noted above, surface production facilities in deepwater are prohibitively expensive for all but the largest fields. When deepwater fields are produced, a common technique includes the use of a subsea tieback. Using this system, a well is completed and production is piped from the subsea wellhead to a remote existing platform for processing and export. This is by no means an inexpensive process. There are a variety factors involved in a deepwater tieback that make it a costly endeavor, including using twin pipelines to transport production, maintain communication with subsea and subsurface equipment, and perform well intervention using a floating rig.

Twin insulated pipelines, using either pipe-in-pipe and/or conventional insulation, are typically used to tie wells back to production platforms on the shelf in order to facilitate round-trip pigging from the platform. The sea-water temperature at the deepwater wellhead is near the freezing temperature of water, while the production fluid coming out of the ground is under very high pressure with a temperature near the boiling point of water. When the hot production fluids encounter the cold temperature at the seabed two classic problems quickly develop. First, as the production temperature drops below the cloud point, paraffin wax drops out of solution, bonds to the cold walls of the pipeline, restricting flow and causing plugs. As the production fluid continues to cool, the water in the produced fluids begins to form ice crystals around natural gas molecules forming, hydrates and flow is slowed or stopped.

To combat these problems, insulated conventional pipe or pipe-in-pipe, towed bundles with heated pipelines, and other "hot flow" solutions are installed. This does help ensure production, but the cost is very high and some technologies, such as towed bundles, have practical length limits. Such lines can easily cost $1 to $2 million a mile, putting it out of reach of a marginal field budget.

Another problem with extended tiebacks, which is what would exist in ultra deepwater where potential host facilities are easily 60 to 100 miles away, is communication with the subsea and subsurface equipment. Communication and control are traditionally achieved either by direct hydraulics or a combination of hydraulic supply and multiplex systems that uses an electrical signal to actuate a hydraulic system at the remote location. Direct hydraulics over this distance would require expensive, high-pressure steel lines to transport the fluid quickly and efficiently and even then the response time would be in the order of minutes. There also is a problem with degradation of the electrical signal over such lengths. This also interferes with the multiplex system and requires the installation of repeaters along the length. While these problems can be overcome the solutions are not inexpensive.

A third major hurdle to cost-effective deepwater tiebacks is well intervention. A floating rig that can operate in ultra deepwater is not only very expensive, more than $200,000 a day, but also difficult to secure since there are a limited number of such vessels. It doesn't take much imagination to envisage a situation in which an otherwise economically viable project is driven deep into the red by an unexpected workover. Anticipation of such expensive intervention has shelved many deep water projects.

While an overall estimated 40% of deep water finds exceed 100 million bbl, by comparison, only 10% of the fields in the Gulf of Mexico shelf are greater than 100 million barrels of recoverable oil equivalent. Further, 50–100 million bbl fields would be considered respectable if they were located in conventional water depths. The problem with the fields is not the reserves, but the cost of recovering them using traditional approaches, such as the subsea tieback. Hence, it would be desirable to recover reserves as low as 25 million bbl range using economical, non-traditional approaches.

Pigging such a single line system could be accomplished using a subsea pig launcher and/or gel pigs. Gel pigs could be launched down a riser from a work vessel that mixes the gel and through the pipeline system to the host platform. In the case of a planned shut-in, the downhole tubing and flowline can be treated with methanol or glycol to avoid hydrate formation to in the stagnant flow condition.

Hence a suitable device for the storage of methanol (for injection) and gel for pigging, as well as pigging and workover equipment, is desired. The preferred devices would be an unmanned control buoy moored above the subsea wells. Further, it is desirable to provide a device that is capable of supporting control and storage equipment in the immediate vicinity of subsea wells.

SUMMARY OF THE INVENTION

The present invention relates to a wellhead control buoy that is used in deepwater operations for offshore hydrocarbon production. The wellhead control buoy is preferably a robust device, easy to construct and maintain. One feature of the present invention is that the wellhead control buoy, also referred to herein as the wave-rider buoy, is suitable for benign environments such as West Africa. Additionally, the present invention is suitable for environments, such as the Gulf of Mexico, in which it is typically the policy to shut down and evacuate facilities during hurricane events.

The wave-rider buoy is so termed because it is a pancake-shaped buoy that rides the waves. The preferred wave-rider buoy is a weighted and covered, shallow but large diameter cylinder, relatively simple to fabricate, robust against changes in equipment weight, relatively insensitive to changes in operational loads, easy for maintenance access, and relatively insensitive to water depth. The wave-rider buoy can be effectively used in water depths up to 3,000 meters using synthetic moorings, and is particularly suitable for use in water depths of at least 1,000 meters. The wave-rider buoy may be used with or without an umbilical from the main platform. An alternate embodiment of the present invention includes a power system located on the buoy.

Important features of the wave-rider buoy include its 1) hull form—similar to a barge and easy to construct,
2) mooring system—catenary or taut, synthetic cables or steel cables, and
3) control system—consists of hydraulic power unit to facilitate control of subsea function at the wellhead. Control command and feedback is provided from/to the platform through a radio link or microwave link with satellite system back-up. On-board and subsea control computers allow the use of multiples control signals, thus reducing the size and cost of the umbilical cable.
4) umbilical—provides a power and control link between the buoy and the subsea equipment. It also includes chemical injection lines and a central tubing core for rapid injection of chemicals or launching of gel pigs into the flow line when needed.

BRIEF DESCRIPTION OF THE DRAWINGS

For a more detailed understanding of the present invention, reference is made to the accompanying Figures, wherein.

DESCRIPTION OF THE PREFERRED EMBODIMENTS

Figure 1:
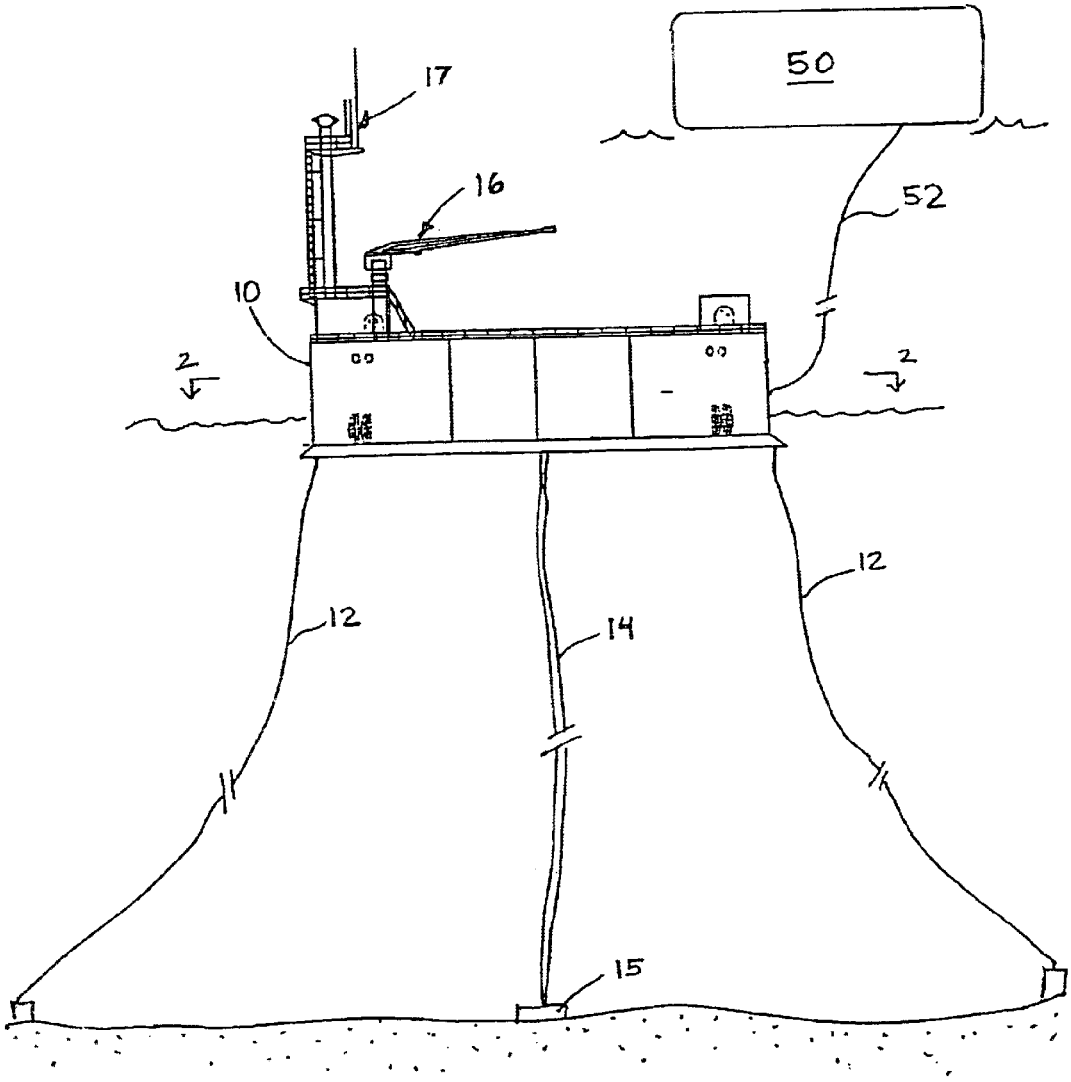
FIG. 1 is a schematic elevation view of a preferred embodiment of the present wave-rider buoy.
Figure 2:
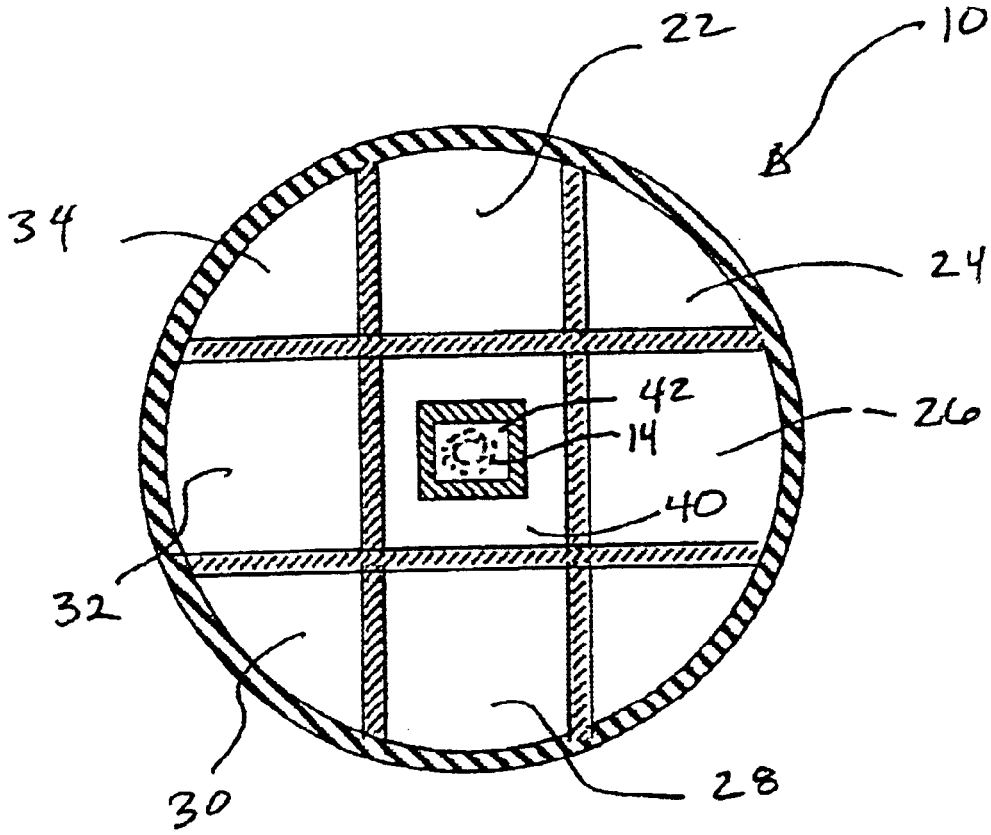
FIG. 2 is a schematic cross-sectional view taken along lines 2—2 of FIG. 1.

Referring to FIGS. 1 and 2, the present wave-rider buoy 10 has a shallow, circular disc shape. The buoy has a very low profile, which allows the buoy to conform to the motion of the waves. The wave-rider buoy 10 is preferably a wide, covered, shallow-draft flat dish that can have catenary moorings 12 with solid ballast or taut synthetic moorings (not shown) so as to achieve the desired motion and stability characteristics.

According to a preferred embodiment, buoy 10 is a cylinder having a diameter to height ratio of at least 3:1 and more preferably at least 4:1. By way of example only, a wave-rider buoy in accordance with the present invention might be 18 m in diameter, with a depth of 4.5 m. These dimensions provide an adequate footprint area for equipment storage and storage tank volume. In a preferred embodiment, the wave-rider buoy has a double bottom (not shown), with the lower level containing up to 500 tons of iron ore ballast or the like. This configuration increases stability.

An umbilical 14 extends from the wellhead 15 on the seafloor to the surface, where it is received in buoy 10 as described below. In a preferred embodiment, buoy 10 optionally includes a crane 16, an antenna 17 for radio communication, and equipment for satellite communication on its upper surface, with all other equipment being installed on one level, thus simplifying fabrication and operational maintenance. Chemical and fuel storage tanks are located below the equipment deck.

In particular, and referring to FIG. 2, the inside volume of buoy 10 can include a generator room 22, diesel oil tank 24, control room 26, HPU, battery and HVAC room 28, methanol/KHI tanks 30, chemical injection room 32, conduit chamber 34, and umbilical manifold room 40. It will be understood that these features are optional and exemplary, and that each could be omitted, duplicated or replaced with another feature without departing from the scope of the invention. Umbilical manifold room 40, which is preferably housed in the center of buoy 10 in order to reduce the risk of damage to the umbilical or its terminus, includes an umbilical connection box 42, which contains conventional connectors (not shown) for flexibly connecting the upper end of umbilical 14 to buoy 10. Also present but not shown is conventional equipment for providing fluid communication between umbilical 14 and methanol tanks 30, chemical injection tanks (not shown) and any other systems within buoy 10 that may involve injection of fluid or equipment into the well.

Unlike tension leg buoy (TLB) or Spar buoy concepts, the whole body of the wave-rider is in the wave zone and thus experiences larger wave forces. In accordance with common practice, it is preferred to avoid hull configurations that result in the destructive resonance of the hull during various wave conditions. Bilge keels, high drag mooring chains and/or other devices can be added to the hull in order to maximizing damping. While catenary or taut synthetic moorings are preferred, it will be understood that the present control buoy can be used with any known mooring system that is capable of providing the desired degree of station-keeping in the planned environment.

Referring back to FIG. 1, a host facility 50 for processing and exporting oil is also shown. A production pipeline 52 extends from wellhead 15 or buoy 10 to host facility 50.

The buoy preferably has the capacity to store several thousands of gallons of fluids for chemical injection or to fuel the electric power generators. The buoy preferably also contains hydraulic and electric communication and control systems, their associated telemetry systems, and a chemical injection pumping system for the subsea and downhole production equipment. It is less expensive to install this buoy system than to provide an umbilical cable to a subsea well 20 miles away from a surface or host facility. For distances over 20 miles, the savings is even greater because the cost of the buoy is fixed.

Diesel generators can be used to power the equipment on buoy 10. Alternatively, it may be desirable to apply fuel cell technology to the concept. Specifically, the buoy could be powered by cells similar to those currently being tested by the automotive industry. In this case, the buoy may run on methanol fuel cells, drawing from the methanol supply stored on the buoy for injection. The generated electric energy could also be used to power seafloor multiphase pumps in deepwater regions with low flowing pressures such as found in the South Atlantic.

The buoy provides direct access to and control of the wells and flowline from the buoy via riser umbilical 14. The preferred flexible hybrid riser runs from the buoy to the seafloor with a 4-in. high-pressure bore in its center and electrical, fiber optic, and fluid lines on the outside. The main axial strength elements are wrapped around the high pressure bore rather than the outside diameter, making the riser lighter and more flexible. This high-pressure bore can be used to melt hydrate plugs by de-pressurizing the back-end of the flowline. The riser bore can also transport gel pigs to the flowline, or perform a production test on a well. Use of the riser bore may require manned intervention in the form of a work vessel moored to the buoy. In this instance, the vessel supplies the health and safety systems necessary for manned intervention, and the associated equipment such as gel mixing and pumping or production testing.

In an alternative embodiment, the buoy is held in place by a synthetic taut mooring system, such as are known in the art. The mooring lines are preferably buoyed or buoyant so they do not put a weight load on the buoy. This allows the same buoy to be used in a wide range of water depths. The physical mobility of the present buoy makes it a viable solution for extended well testing. This in turn allows such tests to be conducted without the need to commit to a long-term production solution. In this embodiment, the buoy preferably includes all of the components needed in an extended test scenario, including access, control systems, chemical injection systems, and the ability to run production through a single pipeline.

The present wave-rider buoy is particularly suitable for use in benign environments such West Africa and in less-benign environments where it is the practice to evacuate offshore equipment during storms. Alternative configurations of the present control buoy include tension tethered buoys and SPAR buoys. In each case, control apparatus and pigging/workover equipment and materials are housed within the buoy, thereby eliminating the need for an extended umbilical or round-trip pigging line.

Without further elaboration, it is believed that one skilled in the art can, using the description herein, utilize the present invention to its fullest extent. The following embodiments are to be construed as illustrative, and not as constraining the remainder of the disclosure in any way.

Well and Pipeline Intervention Option

Access to the wells and flow lines is provided for coiled tubing and wire line operations, to carry out flow assurance, maintenance and workover. Two main alternatives for well access are contemplated. According to the first option, buoy size is kept to a minimum and all workover equipment is provided on a separate customized workover vessel. In the second option, handling facilities and space for the coiled tubing equipment are provided on floating buoy. In this case, the buoy has to be larger. Certain factors can significantly affect the size of the buoy. For example, if it is desired to pull casing using the buoy, sufficient space must be provided to allow for storage of the pulled casing. Some types of tubing pulling, such as pulling tubing in horizontal trees require enhanced buoyancy. Workover procedures that can be performed from the present buoy include pigging, well stimulation, sand control, zone isolation, re-completions and reservoir/selective completions. For example, an ROV can be located on buoy 10, since power is provided. The buoy can also be used to support storage systems for fuels, chemicals for injection, and the like.

What is claimed is:

1. A buoy for supporting equipment for use in a remote offshore well or pipeline, comprising:

a hull having a diameter:height ratio of at least 3:1;

a mooring system for maintaining the hull in a desired location;

an umbilical providing fluid communication between said hull and the well or pipeline;

a telemetry communication system for communication to a host facility; and said umbilical comprising at least production control communication lines and coiled tubing.

2. The buoy according to claim 1 wherein the mooring system is a catenary mooring system.

3. The buoy according to claim 1 wherein the mooring system is a taut mooring system.

4. The buoy according to claim 1 wherein the hull has a diameter:height ratio of at least 4:1.

5. The buoy according to claim 1, further including a pig launcher supported on said hull.

6. The buoy according to claim 5 wherein the pig launcher is a gel pig launcher.

7. The buoy according to claim 1, further including a chemical injection system in fluid communication with the well via said umbilical.

8. The buoy according to claim 1, further including equipment for inserting coiled tubing or wireline equipment into the well.

9. A system for producing hydrocarbons from a subsea well, comprising:

a floating buoy positioned over the well, said buoy having a hull with a diameter:height ratio of at least 3:1;

a mooring system maintaining said buoy in position over the well;

a control umbilical connecting said buoy to the well said umbilical comprising at least production control communication lines and coiled tubing;

a host facility adapted to receive hydrocarbons produced in the well; and a production pipeline connecting the well to said host facility.

10. The system according to claim 9 wherein said buoy includes equipment for inserting coiled tubing wireline equipment into the well.

11. The system according to claim 9 wherein said buoy includes storage for chemicals.

12. The system according to claim 9 wherein said buoy includes chemical injection equipment.

13. The system according to claim 9 wherein said buoy includes blowout prevention equipment in conjunction with a lower riser package.

14. The system according to claim 9 wherein said buoy is unmanned.

15. The system according to claim 9 wherein said production pipeline includes at least one access port between the well and said host facility.

16. The system according to claim 9 wherein said production pipeline includes at least one access port between the well and said host facility and said access port is adapted to allow insertion of a pig into said production pipeline.

17. The system according to claim 9 wherein said production pipeline includes at least one access port between the well and said host facility and said access port is adapted to allow injection of chemicals into said production pipeline.

18. The system according to claim 9 wherein said control umbilical includes equipment for control of at least one of: subsea equipment, hydraulic and electric power units.

19. The system of claim 9 wherein said control umbilical contains electrical, fiber optic, and/or fluid lines on its exterior.

20. The system of claim 9 wherein said control riser umbilical contains a high pressure bore in its center.

21. The system of claim 20 wherein the riser bore transports gel pigs to the flowline.

22. The system of claim 9, further including a power system.

23. The system of claim 22 wherein the power system comprises diesel power generators.

24. A system for producing hydrocarbons from a subsea well, comprising:

a floating buoy positioned over the well, said buoy having a hull with a diameter:height ratio of at least 3:1;

a mooring system maintaining said buoy in position over the well;

a control umbilical connecting said buoy to the well;

a host facility adapted to receive the hydrocarbons produced in the well;

a production pipeline connecting the well to said host facility; and a power system comprising methanol fuel cell power generators.

25. A method for producing hydrocarbons from a subsea well to a host facility; comprising:

positioning a floating buoy with a hull having a diameter:height ratio of at least 3:1 over the well;

connecting the well to the buoy with a control umbilical;

connecting the well to said host facility with a production pipeline;

producing the hydrocarbons from the well through the production pipeline to the host facility; and controlling the production of hydrocarbons through the control umbilical; and inserting coiled tubing into the well through the control umbilical.

26. The method according to claim 25, further including the step of pigging the well from the buoy.

27. The method according to claim 25, further including the step of performing a well stimulation in the well from the buoy.

28. The method according to claim 25, further including the step of providing sand control in the well from the buoy.

29. The method according to claim 25, further including the step of providing zone isolation, re-completions and reservoir/selective completions in the well from the buoy.

30. The method according to claim 25, further including the step of injecting chemicals into the well through the control umbilical.

31. The method according to claim 25 wherein said production pipeline includes at least one access port between the well and said host facility, further including the step of injecting chemicals through the access port.

32. The method according to claim 25 wherein said production pipeline includes at least one access port between the well and said host facility, further including the step of inserting a pig into said production pipeline through the access port.

33. The system of claim 25 wherein production test are performed on the well via the riser bore.

* * * * *